US007114205B2

(12) United States Patent
Choi

(10) Patent No.: US 7,114,205 B2
(45) Date of Patent: Oct. 3, 2006

(54) COLLAPSIBLE BED FRAME

(75) Inventor: Harrison Choi, Fujian (CN)

(73) Assignee: NorthPole Ltd., Kowloon (HK)

( * ) Notice: Subject to any disclaimer, the term of this patent is extended or adjusted under 35 U.S.C. 154(b) by 0 days.

(21) Appl. No.: 10/437,854

(22) Filed: May 13, 2003

(65) Prior Publication Data

US 2004/0000009 A1 Jan. 1, 2004

Related U.S. Application Data

(63) Continuation of application No. 10/227,049, filed on Aug. 23, 2002, now Pat. No. 6,711,761.

(51) Int. Cl.
*A47C 17/64* (2006.01)
*A47C 19/14* (2006.01)
*A47C 27/08* (2006.01)

(52) U.S. Cl. ..... 5/114; 5/115; 5/112; 5/706

(58) Field of Classification Search ..... 5/112, 5/114–117, 174, 175, 176.1, 177, 181, 182, 5/184, 659, 200.1; 297/16.2; 254/93 HP
See application file for complete search history.

(56) References Cited

U.S. PATENT DOCUMENTS

| | | | | | |
|---|---|---|---|---|---|
| 7,712 | A | * | 10/1850 | Whitmarsh | 5/115 |
| 202,685 | A | * | 4/1878 | White | 5/111 |
| 228,920 | A | * | 6/1880 | Murray et al. | 5/115 |
| 540,041 | A | * | 5/1895 | Blomberg | 5/115 |
| 862,346 | A | * | 8/1907 | Pihlblad et al. | 5/115 |
| 904,006 | A | * | 11/1908 | Oberg | 5/115 |
| 998,761 | A | * | 7/1911 | Engstrand | 5/3 |
| 1,097,100 | A | * | 5/1914 | Kallio | 297/106 |
| 1,151,495 | A | * | 8/1915 | Menten | 5/122 |
| 1,176,963 | A | * | 3/1916 | Howell | 297/106 |
| 1,185,568 | A | * | 5/1916 | Zeunert | 108/115 |
| 1,224,782 | A | * | 5/1917 | Pedersen | 5/115 |
| 1,250,697 | A | * | 12/1917 | Strug | 297/106 |
| 1,312,299 | A | * | 8/1919 | Almen | 5/115 |
| 1,367,955 | A | * | 2/1921 | Finstrom | 5/115 |
| 1,758,721 | A | * | 5/1930 | Swartz et al. | 297/106 |
| 1,788,919 | A | * | 1/1931 | Lansberry et al. | 5/115 |
| 2,070,960 | A | * | 2/1937 | Phillips | 254/93 HP |
| 2,416,496 | A | * | 2/1947 | Piciulo | 297/184.15 |
| 2,579,263 | A | * | 12/1951 | Kroha | 5/115 |
| 2,610,824 | A | * | 9/1952 | Grier | 254/93 HP |
| 2,725,578 | A | * | 12/1955 | Keller et al. | 254/93 HP |
| 3,174,722 | A | * | 3/1965 | Alm | 254/93 HP |
| 3,269,770 | A | * | 8/1966 | Pellicane | 297/106 |
| 3,499,682 | A | * | 3/1970 | Orenstein | 297/452.41 |
| 3,967,330 | A | * | 7/1976 | Zawadowsky | 5/114 |
| 4,159,822 | A | * | 7/1979 | Ota et al. | 5/614 |

(Continued)

FOREIGN PATENT DOCUMENTS

EP 256837 A2 * 2/1988

*Primary Examiner*—Robert G. Santos
(74) *Attorney, Agent, or Firm*—Armstrong Teasdale LLP

(57) ABSTRACT

A collapsible bed frame (18) for supporting a mattress, the collapsible frame (18) having a number of frame members (32). A number of pivots (34) connect pairs of the frame members (32) at the midpoints of the frame members (32) to make a number of scissor pairs (35). Pivot assemblies (36) pivotally attach the upper ends of the frame members (32) to upper connector assemblies (40), and pivotally attach lower ends of the frame members (32) to feet (38), thus connecting the scissor pairs (35) to form an extended scissors-frame assembly (33). The upper connector assemblies (40) form a support surface for a mattress.

20 Claims, 15 Drawing Sheets

U.S. PATENT DOCUMENTS 4,384,379 A * 5/1983 Yamada ..... 5/115
4,594,743 A * 6/1986 Owen et al. ..... 5/111
4,598,434 A * 7/1986 Mis ..... 5/200.1
4,670,922 A * 6/1987 Mis ..... 5/200.1
4,688,760 A * 8/1987 Garman et al. ..... 254/93 HP
4,786,032 A * 11/1988 Garman et al. ..... 254/93 HP
4,846,204 A * 7/1989 Sok Kyu ..... 5/113
5,022,105 A * 6/1991 Catoe ..... 5/11
5,299,906 A * 4/1994 Stone ..... 187/275
5,419,534 A * 5/1995 Vesely ..... 254/9 C
5,491,854 A * 2/1996 Music ..... 5/618
5,542,806 A * 8/1996 Kang ..... 414/422
5,598,591 A * 2/1997 Kelley ..... 5/118
D411,387 S * 6/1999 Zheng ..... D6/392
6,082,813 A * 7/2000 Chen ..... 297/16.2
6,134,727 A * 10/2000 Hwang ..... 5/114
6,231,119 B1 * 5/2001 Zheng ..... 297/16.2
6,247,749 B1 * 6/2001 Yu ..... 297/16.2
6,286,812 B1 * 9/2001 Cherry ..... 254/9 C
6,364,410 B1 * 4/2002 Tang ..... 297/16.2
6,382,729 B1 * 5/2002 Wu ..... 297/452.41
6,428,033 B1 * 8/2002 Harrison et al. ..... 280/644
6,446,282 B1 * 9/2002 Wu ..... 5/115
6,457,192 B1 * 10/2002 Choi et al. ..... 5/114
6,564,402 B1 * 5/2003 Lin ..... 5/115
6,581,223 B1 * 6/2003 Wang ..... 5/174
6,654,973 B1 * 12/2003 Van Den Heuvel et al. .... 5/611
6,711,761 B1 * 3/2004 Choi ..... 5/114
6,763,534 B1 * 7/2004 Hwang ..... 5/114
6,776,433 B1 * 8/2004 Harrison et al. ..... 280/647
6,834,404 B1 * 12/2004 Fletcher ..... 5/611
6,899,383 B1 * 5/2005 Hwang ..... 297/16.2
6,925,664 B1 * 8/2005 Twigg ..... 5/113
6,926,355 B1 * 8/2005 Le Gette et al. ..... 297/16.2
6,966,084 B1 * 11/2005 Le Gette et al. ..... 5/129
2001/0054198 A1 * 12/2001 Choi et al. ..... 5/114
2003/0019033 A1 * 1/2003 Choi ..... 5/114
2004/0000009 A1 * 1/2004 Choi ..... 5/174
2004/0034929 A1 * 2/2004 Hwang ..... 5/114
2004/0068796 A1 * 4/2004 Fletcher ..... 5/611
2004/0204240 A1 * 10/2004 Tondino ..... 297/248

* cited by examiner

COLLAPSIBLE BED FRAME

This application is a Continuation of application Ser. No. 10/227,049 filed Aug. 23, 2002 now U.S. Pat No. 6,711,761 and through it claims priority from U.S. application Ser. No. 09/905,606 (U.S. Pat. No. 6,457,192) and U.S. Provisional Applications Ser. Nos. 60/238,662, filed Oct. 4, 2000, and 60/262,767, filed Jan. 19, 2001.

TECHNICAL FIELD

The present invention relates generally to collapsible furniture, and more particularly to bedding which may be used for temporary purposes such as for overnight guests.

BACKGROUND ART

Temporary beds have been used for many years and come in many forms, from a simple futon or air mattress to more complex "hide-a-bed" style devices. Such temporary beds are most often used when guests, either expected or otherwise, stay overnight. In such cases, it is desirable that the temporary bed be quick and easy to assemble, comfortable, and collapse to a small configuration which can be easily and conveniently stored in a closet or storage cabinet. An air mattress has the advantage of deflating to a very compact size when the internal air pressure is released, and can be set up in a relatively short amount of time. The air pressure in the mattress gives good support to body members and the air can redistribute within the mattress slightly in response to greater weight loads in certain areas. It can thus conform to the user's body, is lightweight, and is generally easily portable, even when inflated.

However, air mattresses which are pitched on the floor of a dwelling, may be perceived as being less gracious than beds which are elevated from the floor. Elevated beds may have less intimate contact with floor dirt and grime, thus be more suitable for those with allergies or aversions to dirt. Furthermore, an elevated bed may be easier to get into and out of for those who may have trouble squatting on the floor, or for those with stiff joints or arthritis.

Additionally, those who go camping out of trailers, etc. may wish to sleep out-of-doors, but may wish to isolate themselves from insects, snakes and other forest denizens which may roam the forest floor. For such purposes, an elevated bed, which is easily collapsible and portable, may be very useful. It also may be useful in rocky terrain, or in areas of thorns or burrs, which would otherwise contact the air mattress and possibly puncture it.

Generally, the less effort involved in constructing the bed, the more desirable the typical user would consider the bed to be. People who are contemplating retiring to bed are often already in a state of fatigue or unsteadiness in which the construction of a bed from a collapsed configuration to an expanded configuration may seem a daunting prospect. Therefore, a bed structure which requires minimal involvement by the user in its construction, or, even better, is largely self-erecting, would be very desirable in a variety of situations.

Thus there is a need for a collapsible bed which is elevated from contact with the ground or floor, and which is both very portable and comfortable for the user. There is also a need for a bed which requires minimal involvement by the user in its construction, or, even better, is largely self-erecting.

There have been many variations adjustable beds which are designed so that the bed or a portion of it can incline.

Such an inclining bed allows the user, who may be bed-ridden, or merely relaxing, to assume a sitting position for reading, watching television, etc. Inclining beds have been used in hospitals for many years, and are the subject of numerous U.S. patents, including U.S. Pat. No. 5,870,784, U.S. Pat. No. 5,105,486, U.S. Pat. No. 4,774,732, U.S. Pat. No. 4,025,972, U.S. Pat. No. 3,974,530, U.S. Pat. No. 6,405,393, U.S. Pat. No. 3,644,946, U.S. Pat. No. 3,655,528, U.S. Pat. No. 6,276,011 and others. These beds are generally bulky and often included motor-powered apparatus to achieve the inclination. There have a been a few attempts to use air pressure to change the inclination of the mattress, such as are found in U.S. Pat. No. 5,170,522, U.S. Pat. No. 4,873,731 and U.S. Pat. No. 5,421,044. These beds too are generally bulky and designed for stationary use.

Collapsible beds are increasingly popular with the public as a way of providing easy and elegant bedding for visitors or for those with limited floor-space who appreciate having a bed that can be removed from use when not needed. Air-mattress beds are a convenient variation on this, as the volume of the bed is easily reduced merely by venting the internal air. However, as discussed above, air mattresses which are pitched on the floor of a dwelling, may be perceived as being less gracious than beds which are elevated from the floor. Elevated beds may have less intimate contact with floor dirt and grime, thus be more suitable for those with allergies or aversions to dirt. Furthermore, an elevated bed may be easier to get into and out of for those who may have trouble squatting on the floor, or for those with stiff joints or arthritis.

For these reasons, it is desirable to have a frame which is collapsible under a mattress which is also preferably collapsible. However, applicant is unaware of any mechanism which allows the bed or frame of a collapsible frame to incline. Thus, a user of this style bed would need to position the bed adjacent to a wall and brace the feet from sliding in order to be able to sit up in bed.

Thus there is a need for a collapsible bed and bed frame which can incline to allow comfortable sitting by the user.

DISCLOSURE OF INVENTION

Accordingly, it is an object of the present invention to provide a collapsible bed which collapses to a compact configuration.

Another object of the invention is to provide a bed which inclines to allow the user to sit at an upright angle.

And another object of the invention is to provide an inclining bed frame which can be used with a variety of mattresses.

A further object of the present invention is to provide an inclining bed frame which can be particularly used with an inflatable air mattress.

An additional object of the present invention is to provide an inclining bed frame which is an extended scissor-frame construction.

Yet another object of the present invention is to provide an inclining bed frame which is self-expanding when attached to an inflating air mattress.

A yet further object of the present invention is to provide an inclining bed frame which expands from a central area.

Briefly, one preferred embodiment of the present invention is a collapsible bed frame for supporting a mattress, having a number of frame members. There are a number of pivots which connect pairs of the frame members at the midpoints of the frame members to make a number of scissor pairs. Pivot assemblies pivotally attach the upper ends of the frame members to upper connector assemblies, and pivotally attach lower ends of the frame members to feet, thus connecting the scissor pairs to form an extended scissors-frame assembly. The upper connector assemblies form a support surface for a mattress.

An advantage of the present invention is that the bed frame is collapsible to a compact configuration.

Another advantage of the present invention is that the bed frame is configured as an extended scissor-frame construction so there are no loose pieces that can be misplaced.

And another advantage of the present invention is that the inclining collapsible bed frame is self-expanding when attached to an inflating air mattress so that the frame expands in response to increasing air pressure in the air mattress.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
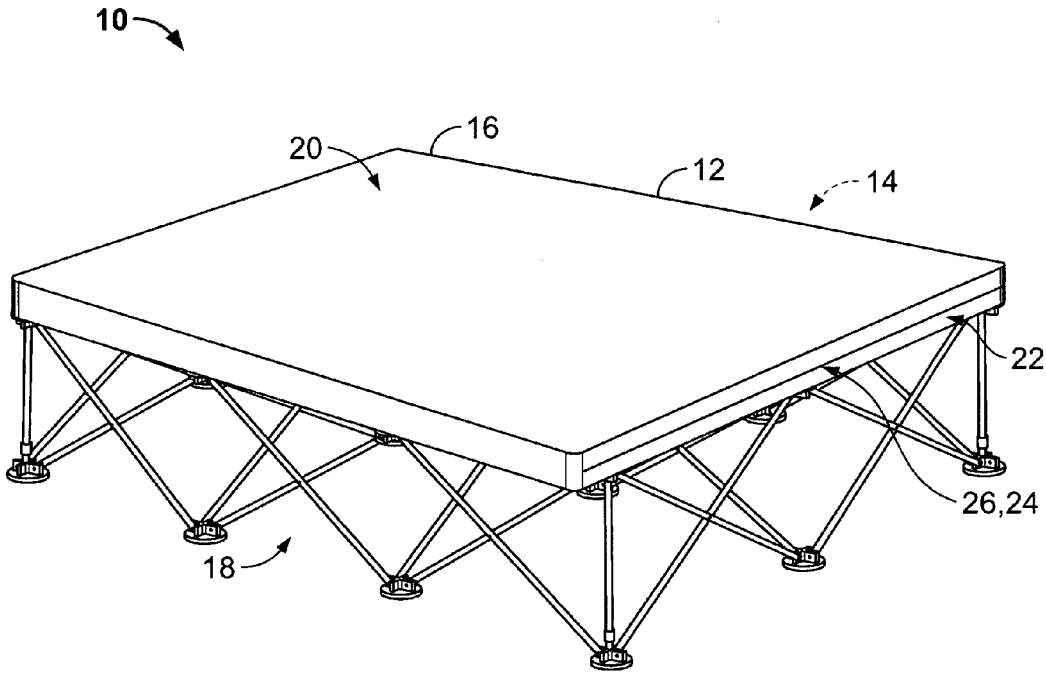
FIG. 1 is an isometric view of the air bed with elevated support structure used in the preferred embodiment of the present invention.

A preferred embodiment of the present invention is an air bed with a support structure. As illustrated in the various drawings herein, and particularly in the view of FIG. 1, a form of this preferred embodiment of the inventive device is depicted by the general reference character 10.

Figure 2:
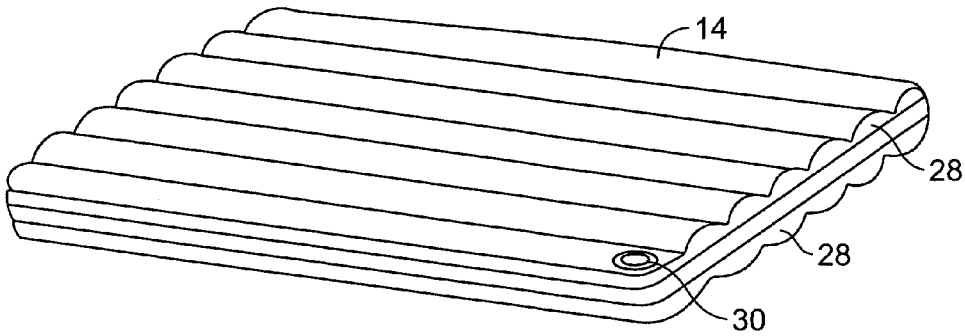
FIG. 2 is an isometric view of the air mattress used in the preferred embodiment of the present invention.
Figure 3:
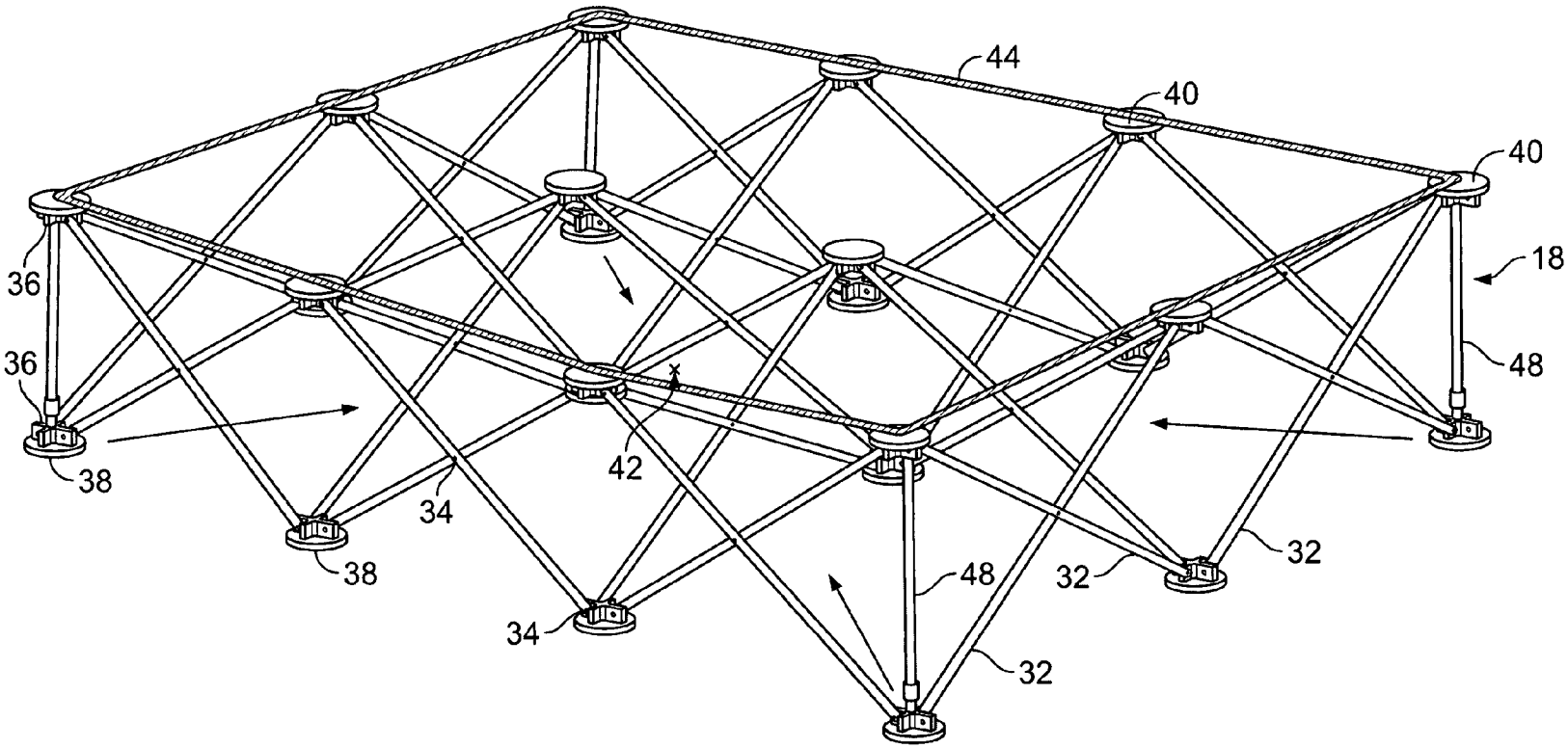
FIG. 3 is an isometric view of the frame structure used in the preferred embodiment of the present invention.

FIGS. 1–3 illustrates an air bed with an elevated support structure 10, having generally an air bed 12 which includes an air mattress 14 (not visible in FIG. 1) and a fabric covering 16, and a support frame 18. The fabric covering 16 includes generally a bag enclosure 20 having an entry mouth 22 which is sealed with a closure fastener 24, which is preferably a zipper 26, but which is also possibly any conventional device such as Velcro, hook-and-eye fasteners, etc. The fabric covering 16 can be plastic, cloth, leather, etc. and encloses at least a portion of the air mattress 14, shown in FIG. 2, which is inserted into the entry mouth 22, either before or after inflation. The zipper 26 is then closed to complete the installation of the air mattress 14. The air mattress 14 can also be removed as desired through the same entry mouth 22, again, either before or after the air mattress 14 is deflated. The air mattress 14 preferably has a number of cells 28 and at least one inflation port 30 through which air is introduced to inflate the air mattress 14. The fabric covering 16 need not completely enclose the entire air mattress, but may enclose only a portion or portions such as the ends or sides of the air mattress 14.

FIGS. 3 and 21–23 shows the articulated support frame 18 which includes a number of frame members 32 which are attached to each other at pivots 34, some of which are positioned at the midpoints of the frame members 32, and some of which are included in pivot assemblies 36 in the feet 38 and upper connector assemblies 40. These pivot assemblies 36 and pivots 34 connect all the frame members 32 to each other, so there are no loose pieces to be gathered and assembled. The frame can be thought of as an extended scissors-frame assembly 33 since the tops and bottoms of each pair of frame members 32 scissor together or apart. These scissor pairs 35 are then joined in an extended assembly where the ends of multiple pairs 35 are joined at the pivot assemblies 36. They also allow the frame 18 as a whole to be collapsed or expanded in a very easy and efficient manner. Force directed at any one of the corners causes movement in all the other corners, so that there is movement of the whole frame in either an inward or outward direction, relative to a central area. The pivots 34 allow the frame structure 18 to move towards a central area 42 from all sides as a unit when the frame 18 is to be collapsed, and to move away from this central area 42 when expanding.

This configuration will be spoken of as "expanding outwardly from a central area", although it is to be understood that one of the feet may actually remain in fixed position, while the remainder of the feet move outward. In other words, the central reference area from which the feet move, may itself move laterally. One example of this occurs when the collapsed support frame is placed in the corner of a room, where, say, the left rear foot of the frame is in the left rear corner of the room, and thus is constrained from movement in a further leftward or rearward direction. When the frame expands, all the other, non-constrained feet will expand outwardly from a central area to the right, or forward, or both, even as the central area itself will move to the right and forward, relative to the immobile left rear foot.

It should also be understood that all the lines of direction of the movement of the feet are not expected to intersect at a precise point. The central area 42 is thus a relatively small region from which the feet 38 move outwardly, but there should be no inference that all feet must move in a specific lines, such as radially from a single specific center point. To one skilled in the art, it will be apparent that if such precise directionality were attempted, manufacturing errors would inevitably introduce variations. Thus, the expansion is considered to move outwardly from a central area or region, and should not be construed to imply any particular lines of direction, other than generally outward from this central area. The direction arrows and central area 42 shown in FIG. 3, and later in FIGS. 12 and 13 below, are therefore not provided to show specific lines of movement which must be followed, but merely a general direction of movement towards, or away from, a general central area 42.

The articulated frame 18 also optionally includes support webbing 44, which may have hooks (not shown) which anchor the support webbing to the frame members 32 and/or the upper connector assemblies 40, and may also have attachment points (not shown) for securing the fabric covering 16 to the webbing 44 and thus to the frame 18.

Figure 4:
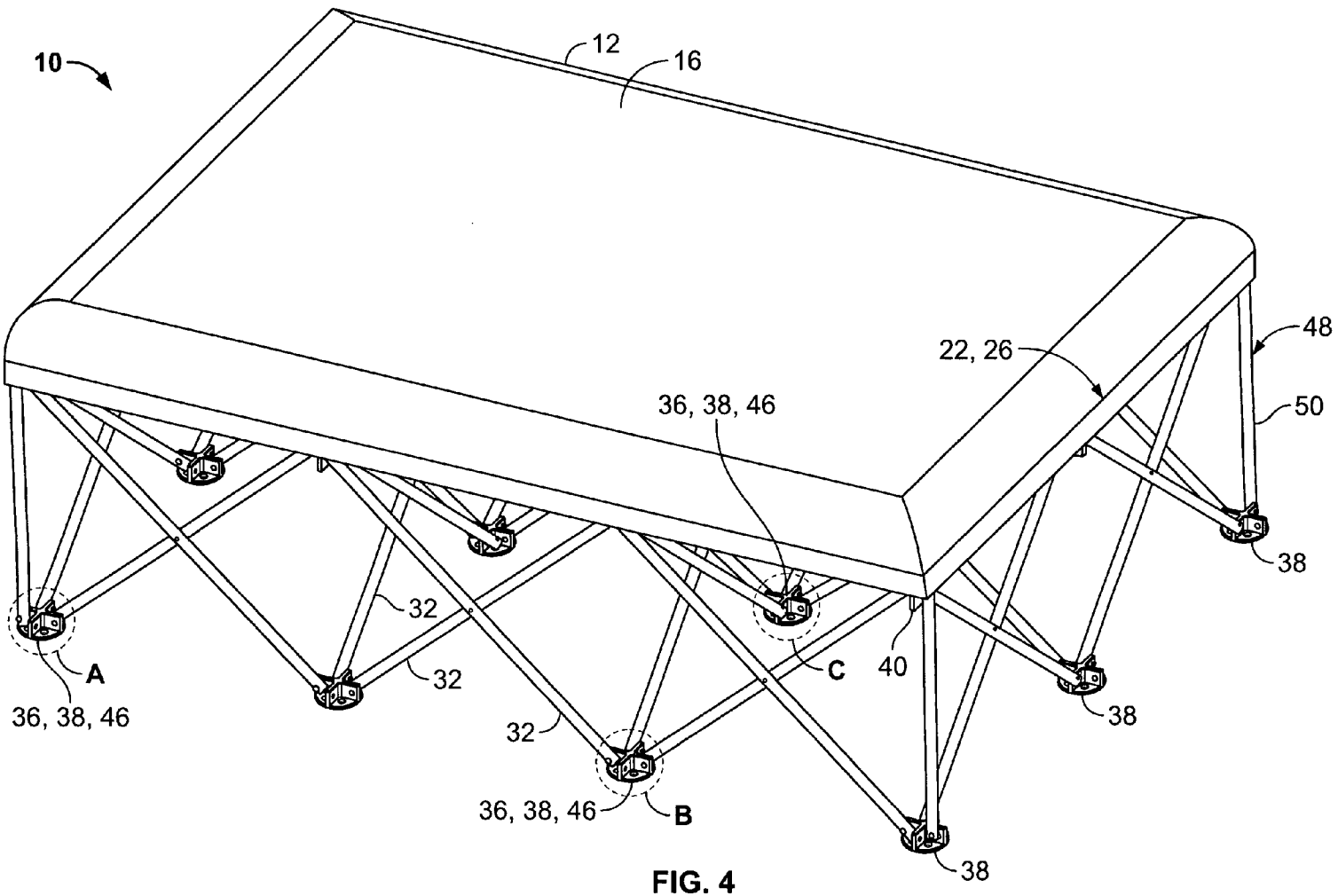
FIG. 4 is a top isometric view of the air bed with elevated support structure of the present invention.
Figure 5:
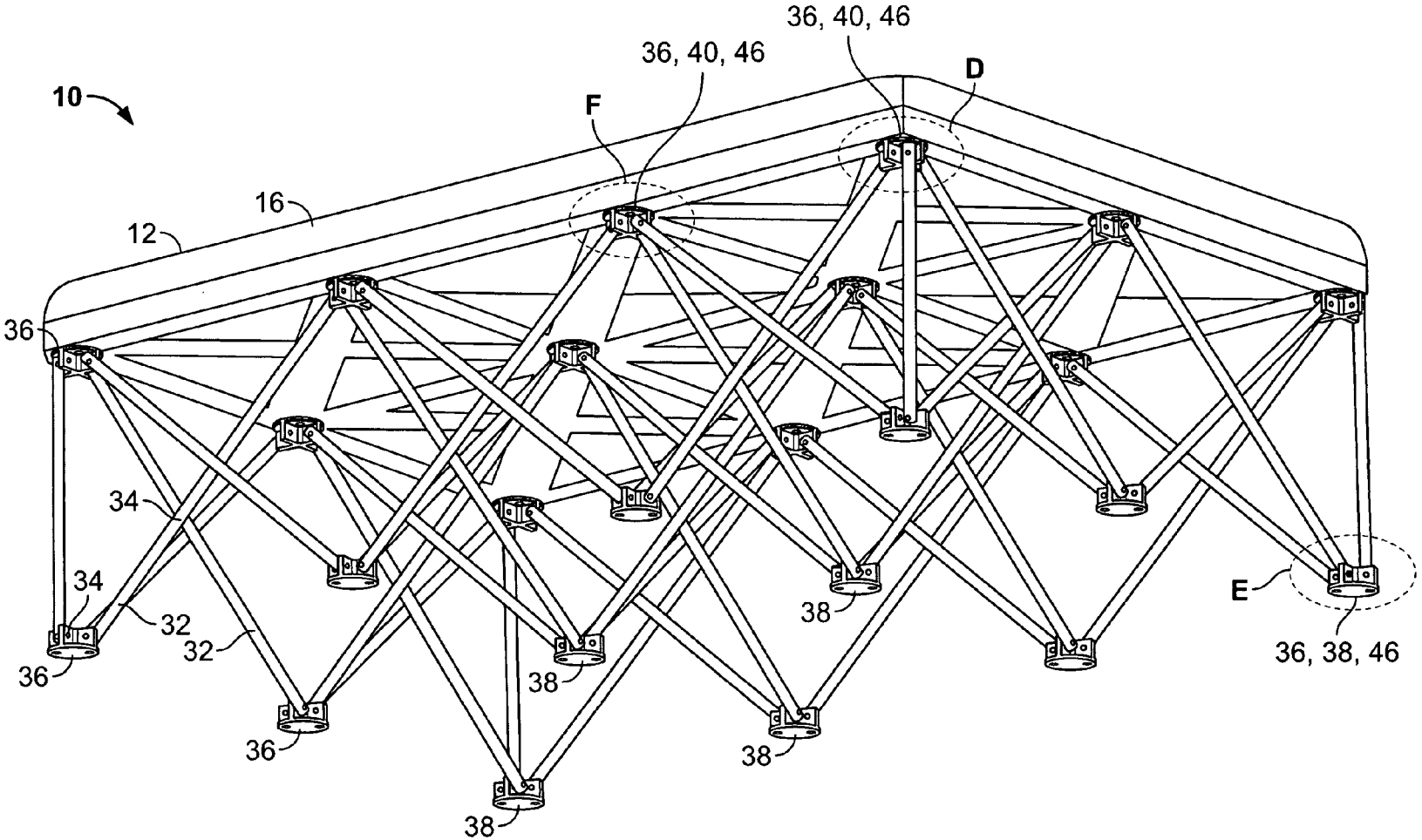
FIG. 5 is a bottom isometric view of the air bed with elevated support structure of the present invention.
Figure 10:
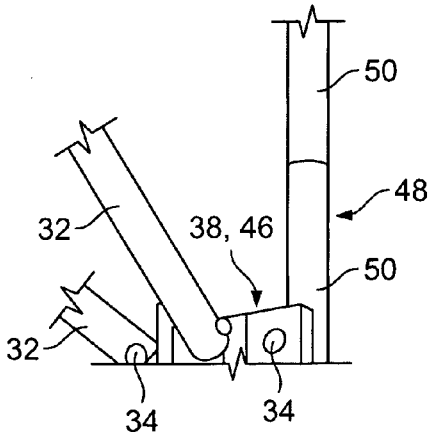
FIG. 10 is a detail view of the pivot assembly seen in detail circle E of FIG. 5.

FIGS. 4 and 5 show closer views of the assembled air bed 10 in which several of the pivot assemblies 36 are selected for detail views in detail circles A–F. The pivot assemblies 36 of the feet 38 and the upper connector assemblies 40 in this embodiment are made to receive 4 connections and thus will be called four-pivot connectors 46. These are preferably reversible, so that the same four-pivot connector 46 can be used as a foot 38 and as an upper connector assembly 40, thus making for uniformity, and ease of manufacturing. The frame members 32 too are preferably interchangeable and of uniform length, with the exception of the corner uprights 48, which are positioned in each of the four corners. These are composed of two or more corner members 50, which may slide within each other in order to extend or contract in length. This is desirable because when the frame 18 is in collapsed position, the corner uprights 48 must be of greater length than when the frame 18 is expanded. In the expanded position therefore, one of the corner members will preferably slide within the other, as shown in FIGS. 6 and 10 below.

Figure 6:
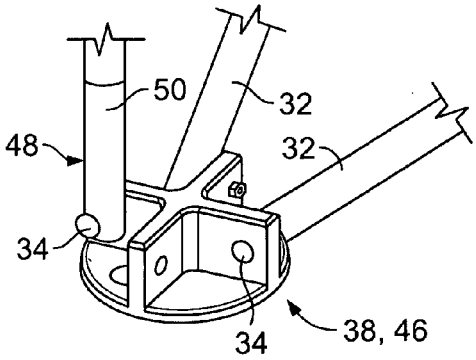
FIG. 6 is a detail view of the pivot assembly seen in detail circle A of FIG. 4.

FIG. 6 illustrates a foot 38, a type of four-pivot connector 46, which is seen in detail circle A of FIG. 4. Frame members 32, pivots 34, and corner upright 48 and its included corner members 50 are shown.

Figure 7:
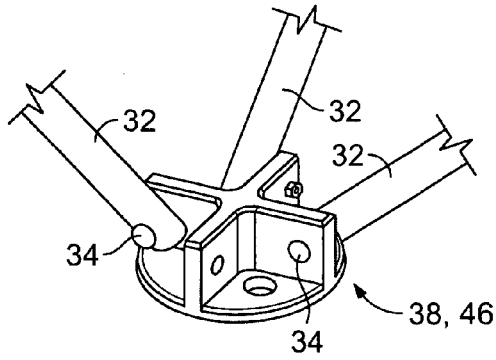
FIG. 7 is a detail view of the pivot assembly seen in detail circle B of FIG. 4.

FIG. 7 shows a foot 38, a type of four-pivot connector 46, which is seen in detail circle B of FIG. 4. Frame members 32, and pivots 34 are also shown.

Figure 8:
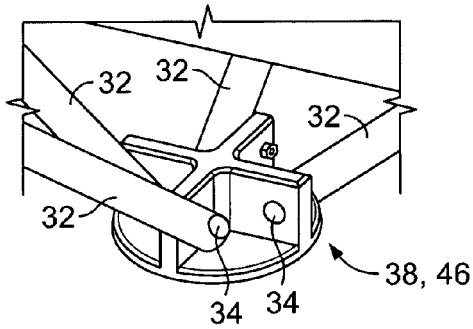
FIG. 8 is a detail view of the pivot assembly seen in detail circle C of FIG. 4.

FIG. 8 illustrates a foot 38, a type of four-pivot connector 46, which is seen in detail circle C of FIG. 4. Frame members 32, and pivots 34 are shown.

Figure 9:
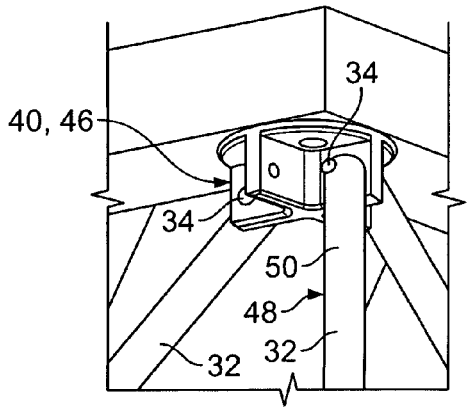
FIG. 9 is a detail view of the pivot assembly seen in detail circle D of FIG. 5.

FIG. 9 shows an upper connector assembly 40, a type of four-pivot connector 46, which is seen in detail circle D of FIG. 5. Frame members 32, corner upright 48 and its included corner member 50 are also shown.

FIG. 10 illustrates a foot 38, a type of four-pivot connector 46, which is seen in detail circle E of FIG. 5. Frame members 32, corner upright 48, pivots 34 and its included corner members 50 are shown.

Figure 11:
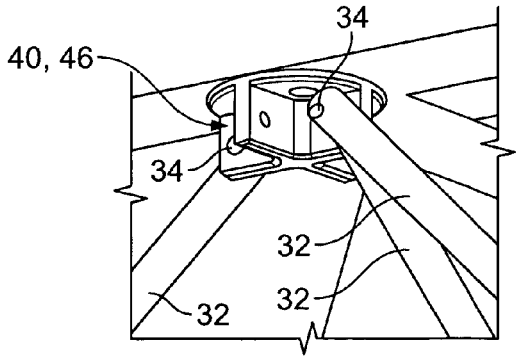
FIG. 11 is a detail view of the pivot assembly seen in detail circle F of FIG. 5.

FIG. 11 shows an upper connector assembly 40, a type of four-pivot connector 46, which is seen in detail circle F of FIG. 5. Frame members 32, and pivots 34 are also shown.

Referring now also to FIGS. 1 and 2, thus the assembly sequence allows for the support frame 18 to be placed upright, expanded, the fabric covering 16 attached to the frame 18 and the air mattress 14 inserted into the entry mouth 22 of the bag enclosure 20, and the fastener 24 closed, and the bed is ready to receive bed clothes, or be otherwise used.

Figure 12:
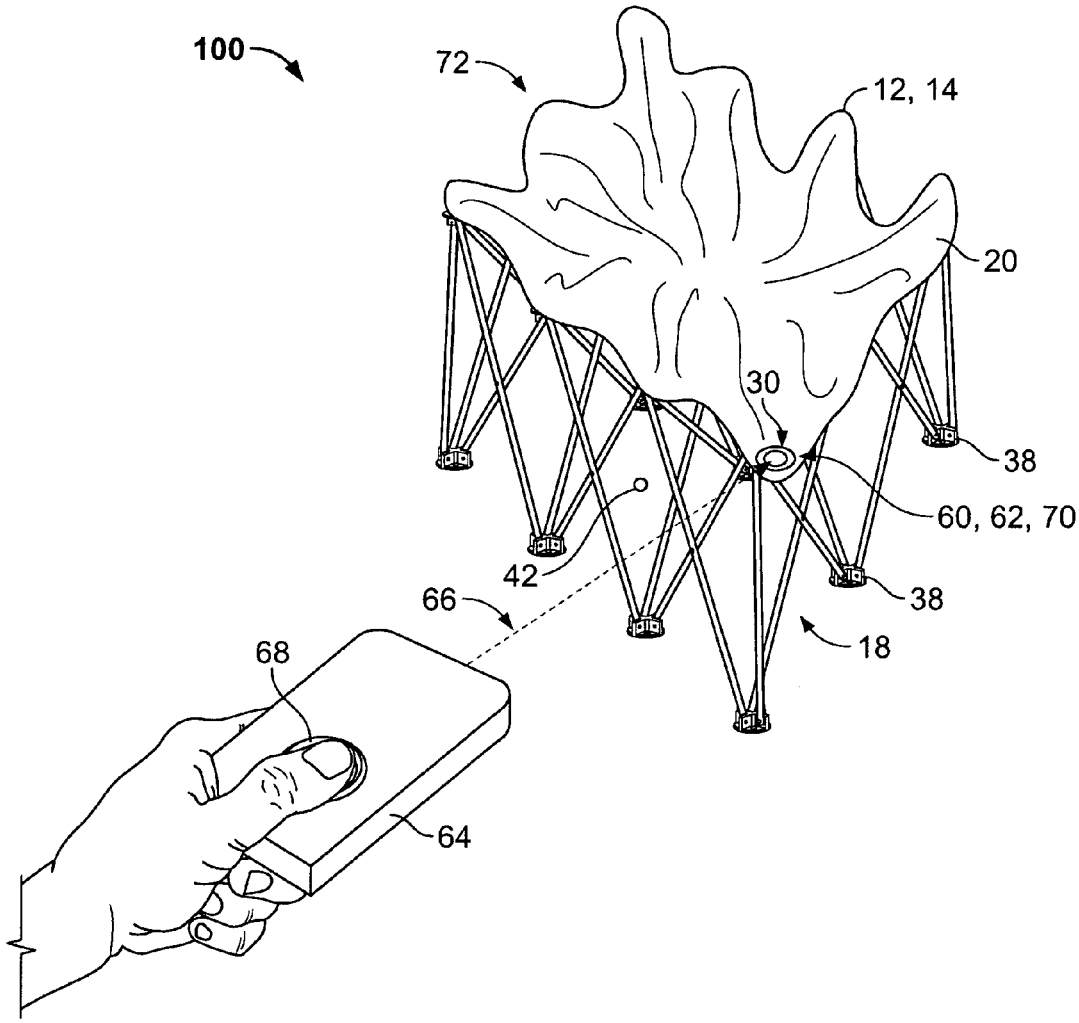
FIG. 12 is an isometric view of a self-expanding bed and frame, which is in a collapsed configuration.
Figure 13:
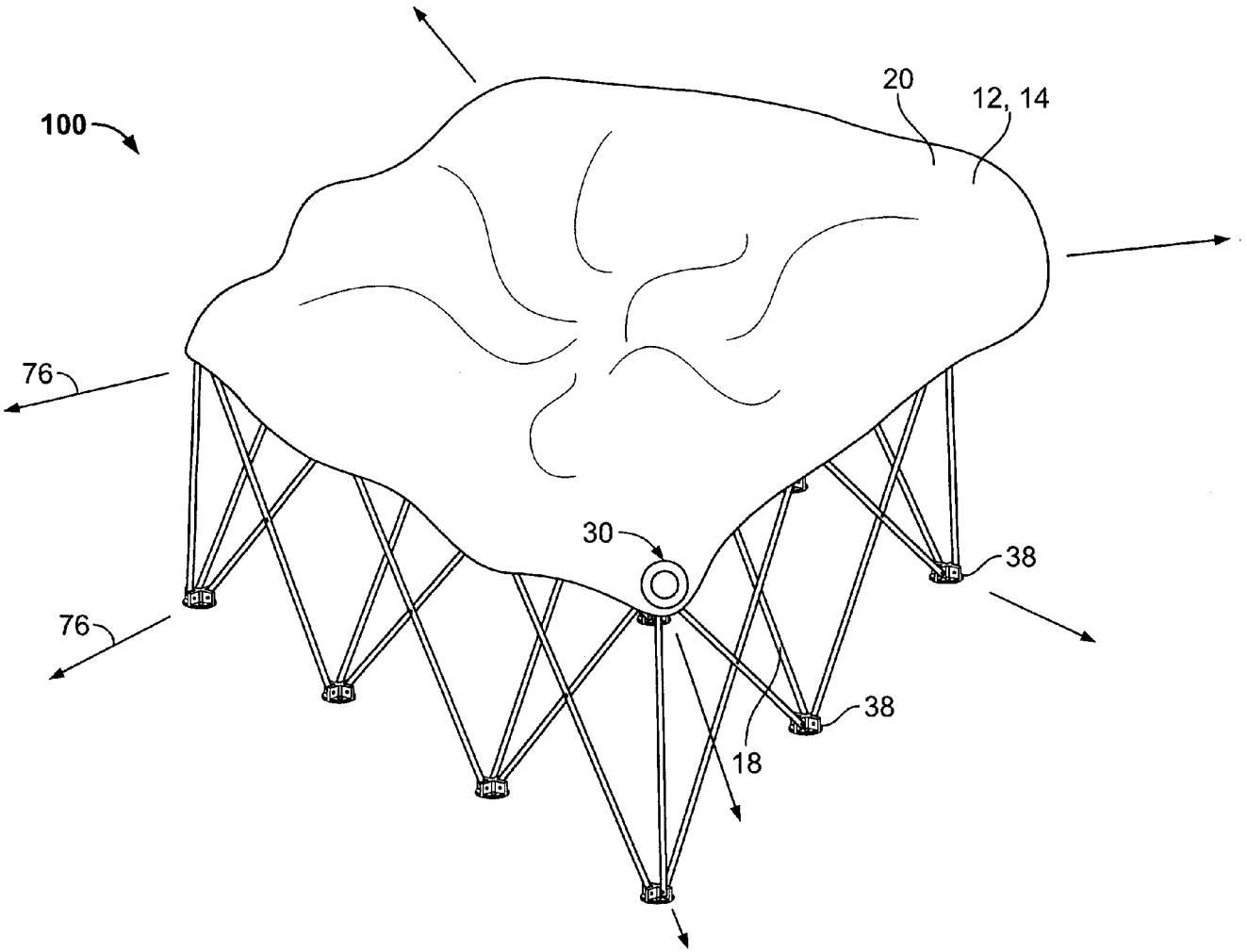
FIG. 13 is an isometric view of a self-expanding bed and frame, which is in transition from a collapsed to an expanded configuration.

A useful variation on this invention is an air-bed with a self-expanding support structure. This is shown in FIG. 12 as element 100. The structure and elements are much the same, and when elements correspond to those used previously, the same element numbers will be used.

The air-bed 12 with air mattress 14 is attached to a support frame 18, either directly, or preferably through a bag enclosure 20. The attachment may be permanent or removable, by such conventional means as buttons, snaps, Velcro®, etc., but it is important that the air mattress 14, as it expands, is attached at multiple points to the frame 18, so that the frame 18 is urged to move with the expansion of the air mattress 14, as discussed below. There is a fabric covering 16 as described previously, which may also be the bag enclosure 20, which protects the air mattress 14 from damage at points where it is rubbed against the frame structure 18 while inflating or deflating.

An air pump 60 is connected to an inflation port 30. The air pump 60 is electrically operated, and can be powered either by wall current or by batteries. If batteries are used, they may be included in a battery pack (not shown). The air pump 60 preferably includes a sensor 62, which can be operated by a beam 66 or communicating means from a remote control 64. The beam 66 or communicating means is preferably cordless, such as radio or infra-red diode laser beam, etc. The remote control 64 preferably has an on-off button 68, which activates and deactivates the electric pump 60. This remote control 64 is by no means a necessity, and the air pump 60 will preferably have a manual on-off switch 70 for back-up operation if the remote 64 is misplaced or the remote's batteries are low, or if the bed 100 is designed not to be operated by remote control at all.

In operation, the bed 100 will be assumed to start in a collapsed configuration 72, as in FIG. 12. The mattress 14 is squeezed together and is generally surrounded by the support frame 18, the frame 18 previously having been drawn together towards the central area 42, discussed above. The frame 18 is set upon its feet 38, and the air pump 60 is activated, either by operation of a manual on-off switch, or by pressing the button 68 on a remote control 64. The air pump 60 begins filling the air mattress 14 which then begins to expand generally out from the central area 42, as indicated by the direction arrows 76 in FIG. 13. As the mattress 14 expands it presses on the members of the frame 18, which pushes them also in the direction away from the central area 42. The feet 38 may be optionally fitted with low friction pads which can thus slide across floor surfaces, or may also be fitted with wheels to allow the frame 18 to expand easily and without hindrance.

The air pump 60 may be permanently attached to the mattress 14, or it may be removable in order to allow access to the inflation port 30 by either a hand pump or by mouth in case electrical power is unavailable for the electrical pump 60, or if it breaks down.

Figure 14:
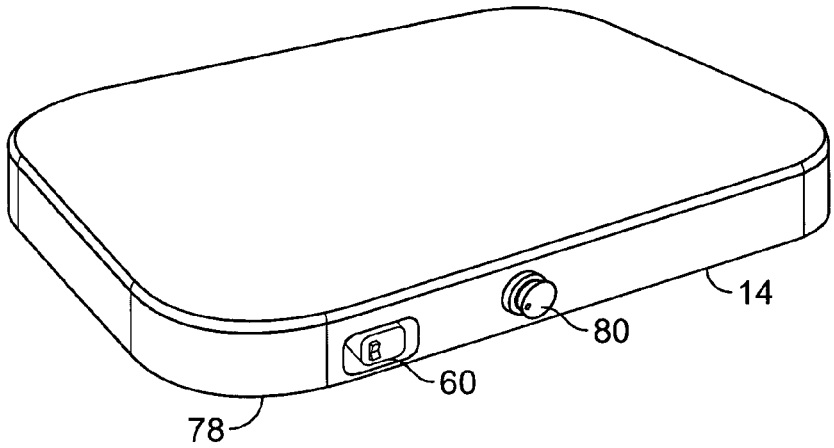
FIG. 14 shows an isometric view of the air mattress of the present invention.
Figure 15:
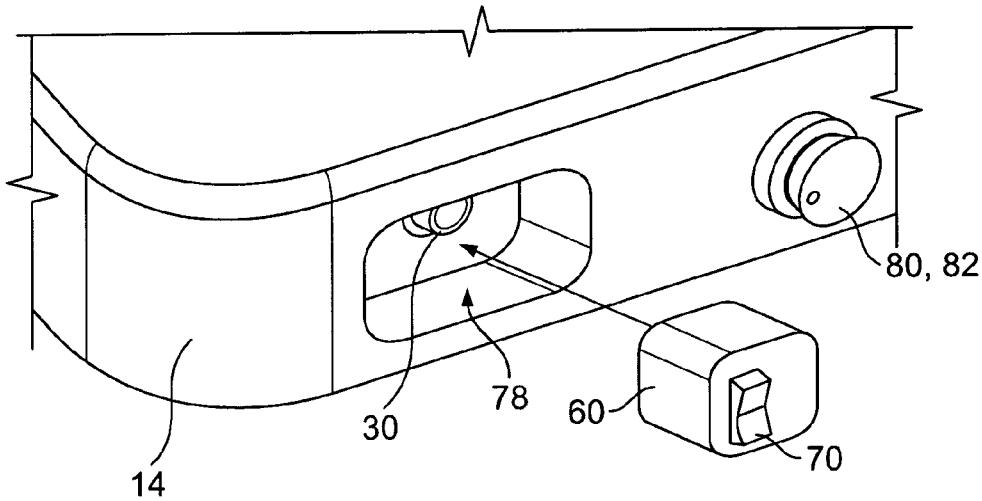
FIG. 15 is a detail view of the corner of the air mattress containing a pump and inflation port.

FIG. 14 shows an isometric view of an air mattress 14 and air pump 60 which has been attached to the inflation port 30 of the air mattress 14. FIG. 15 shows a detail view of the inflation port 30 from which the air pump 60 has been removed. Referring to both FIGS. 14 and 15, the air mattress 14 preferably has a recess area 78 into which the inflation port 30 has been seated. This recess area 78 allows the air pump 60 to fit smoothly without extending far beyond the perimeter of the mattress 14, thus protecting it from being bumped or knocked away from its position at the inflation port 30. Thus, the air pump 60 can be maintained in position after the inflation is complete. Of course, the use of a recess area is optional and should not be considered as a limitation. Also, the air pump 60 may be made to be routinely removed after operation. In this case a self-sealing valve (not shown) is provided for the air mattress 14. A manual on-off switch 70 is also shown, which is preferably included even when the pump 60 is expected to be operated by remote control.

Another optional feature is a secondary inflation port 80, which may be used for attachment of a manual air pump or for inflation by lung power. This may be a conventional air valve as generally used in air mattresses. It may also be used as a venting port 82 for allowing air pressure out of the mattress 14 if the air pump 60 is to be maintained in position, perhaps permanently.

The preferred embodiment 100 of this invention uses an air pump 60 which is removable. The air pump 60 and inflation port 30 are preferably fitting with a friction lock (not visible) similar to those used to attach lens to cameras, and which forms an airtight seal between the two parts.

The pump 60 also preferably contains a pressure sensor or self-regulator (not visible) which detects or acts when the air pressure in the mattress 14 has reached a predetermined level, and which then shuts off the air pump 60. This is also not a required feature and should not be construed as a limitation.

As mentioned above, the electrical air pump 60 may be operated from batteries, perhaps from a battery pack. The bed 100 is thus usable in the outdoors or in a cabin which is not equipped with power lines.

This style of frame structure, which is shown in FIGS. 1–15 has many advantages, as it is constructed of a number of cross-members which are attached to each other at pivots, some of which are positioned at the midpoints of the frame members, and some of which are included in pivot assemblies in the feet and upper connector assemblies. As discussed above, these pivot assemblies and pivots connect all the frame members to each other, so there are no loose pieces to be gathered and assembled. The frame can be thought of as an extended scissors-frame assembly since the tops and bottoms of each pair of frame members scissor together or apart. These scissor pairs are then joined in an extended assembly where the ends of multiple pairs are joined at the pivot assemblies. They also allow the frame as a whole to be collapsed or expanded in a very easy and efficient manner. However, applicant is unaware of any mechanism which allows the bed or frame of a collapsible frame to incline. Thus, a user of this style bed would need to position the bed adjacent to a wall and brace the feet from sliding in order to be able to sit up in bed.

An additional embodiment has been designed to address this problem by allowing a portion of the frame to incline. This embodiment of the present invention is an inclining collapsible bed, which is illustrated in FIGS. 16–20, and will be designated by the reference number 200. Where elements are similar to those described with reference to the first embodiment, the same reference numbers will be used. Elements which are peculiar to this additional embodiment will generally be referred to by a three digit reference number prefaced by a "2".

Figure 16:
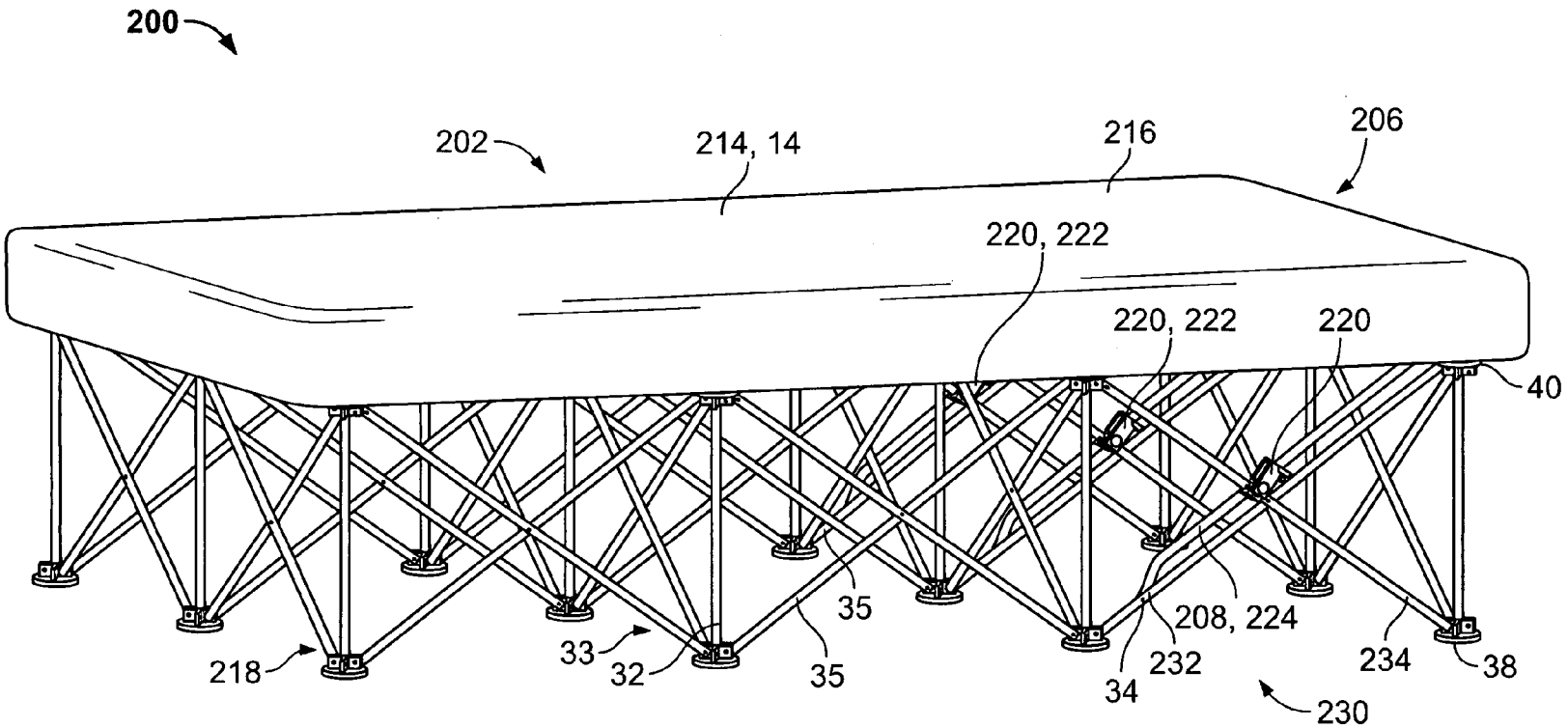
FIG. 16 is a side perspective view of an inclining collapsible bed in reclining position.
Figure 17:
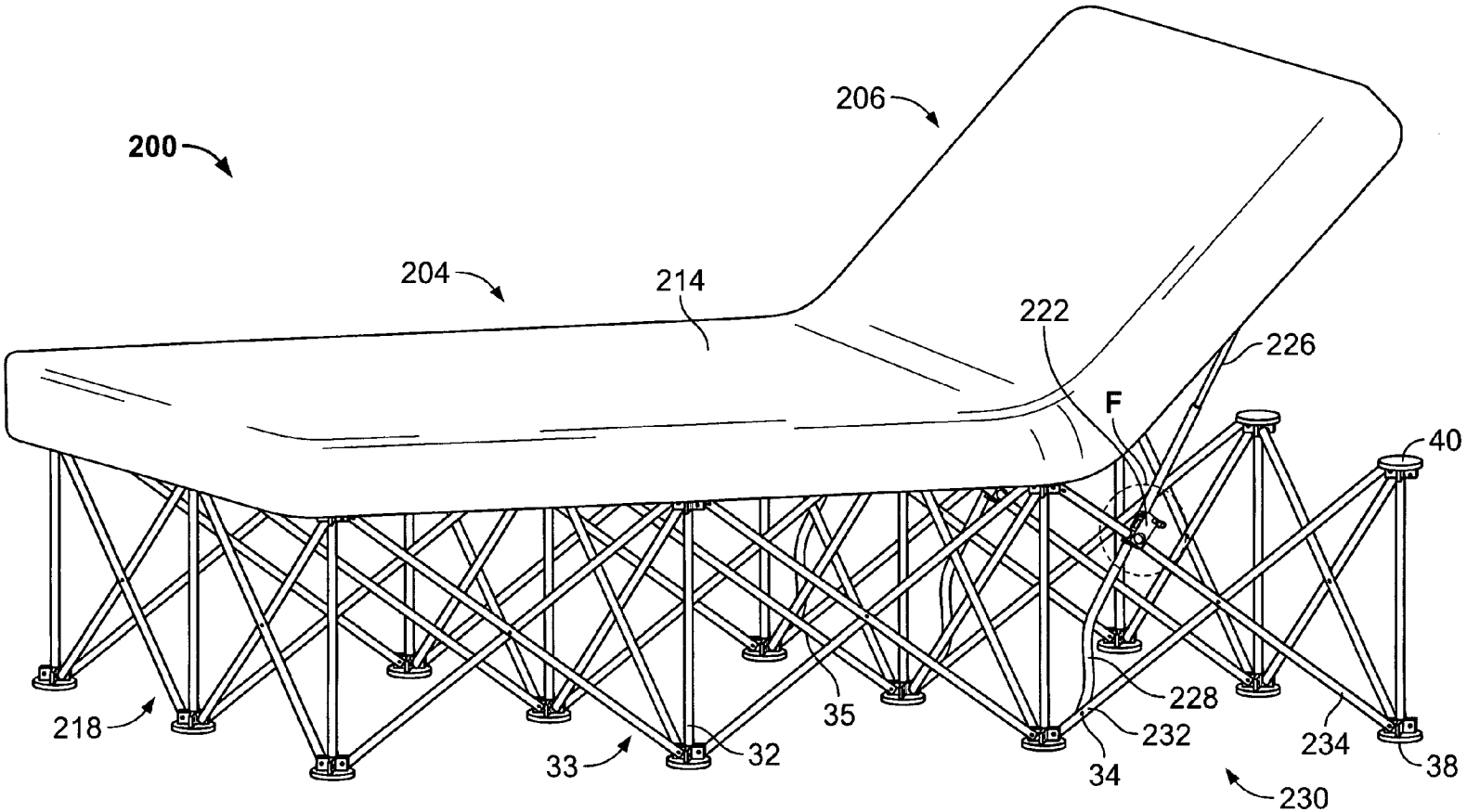
FIG. 17 is a side perspective view of an inclining collapsible bed in inclining position.

FIG. 16 shows a front perspective view of the present inclining bed 200 and frame 218 with the bed in fully reclining position 202 and FIG. 17 shows a front perspective view of the bed in inclining position 204. Detail circle F of FIG. 17 is shown in a close-up view in FIG. 18. The angle-retention mechanism 220 is shown in more detail in FIG. 19 and also in an exploded view in FIG. 20.

Referring now to FIGS. 16–20, the support frame 218 supports a mattress 214, which can be an air mattress 14, but may also be any number of conventional mattresses or futons, as long as they are flexible or have a hinge in the region where the angle of incline begins. The frame 218 is again preferably composed of frame members 32 which are configured in scissor pairs 35 which are in turn configured in an extended scissor frame assembly 33, as described above. The frame 218 includes an inclining portion 206 which includes inclining support members 208, preferably telescoping poles 224, having an inner pole 226 and an outer pole 228 (see FIG. 19 especially), and an angle retention mechanism 220, which is preferably a clamp or adjustable clip 222. Three adjustable clips 222 are shown in the figure, preferably one for each line of frame members included. The end-most scissor pair 230 of the extended scissor frame assembly 33 has a upward angled member 232 which connects to the upper connector assembly 40 at the head-end corner of the frame 218, and an downward angled member 234, which connects to the corner foot 38. For this discussion, upward and downward angled are taken with respect to the foot of the frame 218 moving towards the head of the frame 218. The upward and downward angled members 232, 234 may be identical to the other scissor pairs 35 with the exception of having a pivot hole for connection of the telescoping pole 224, and having retention notches, to be discussed below.

The telescoping poles 224 are pivotally connected to the upward angled members 232 by pivots 34. The telescoping poles 224 and downward angled members 234 pass through holes in the adjustable clips 222.

As shown especially in FIG. 17, as the bed frame 218 is inclined, the telescoping pole 224 pivots at its attachment with the upward angled member 232. As it does so, the adjustable clip 222 moves upward and towards the rear of the downward angled member 234, and also moves upward on the telescoping pole 224.

Figure 18:
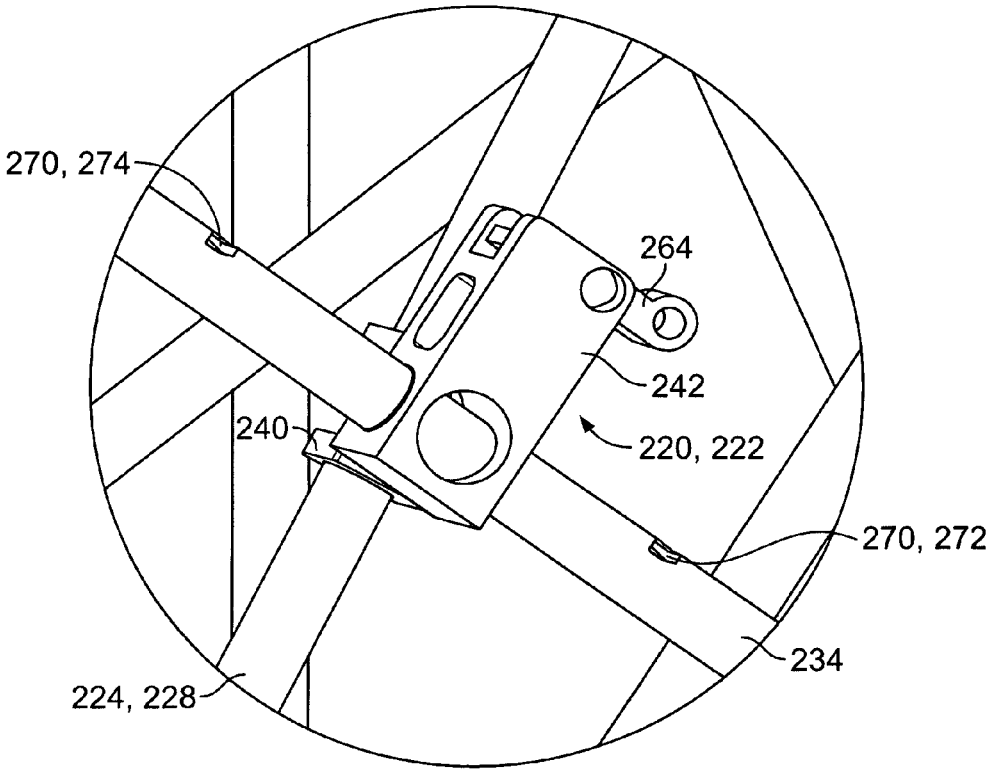
FIG. 18 is a close-up view of the angle retention mechanism included in detail circle F of FIG. 17.
Figure 19:
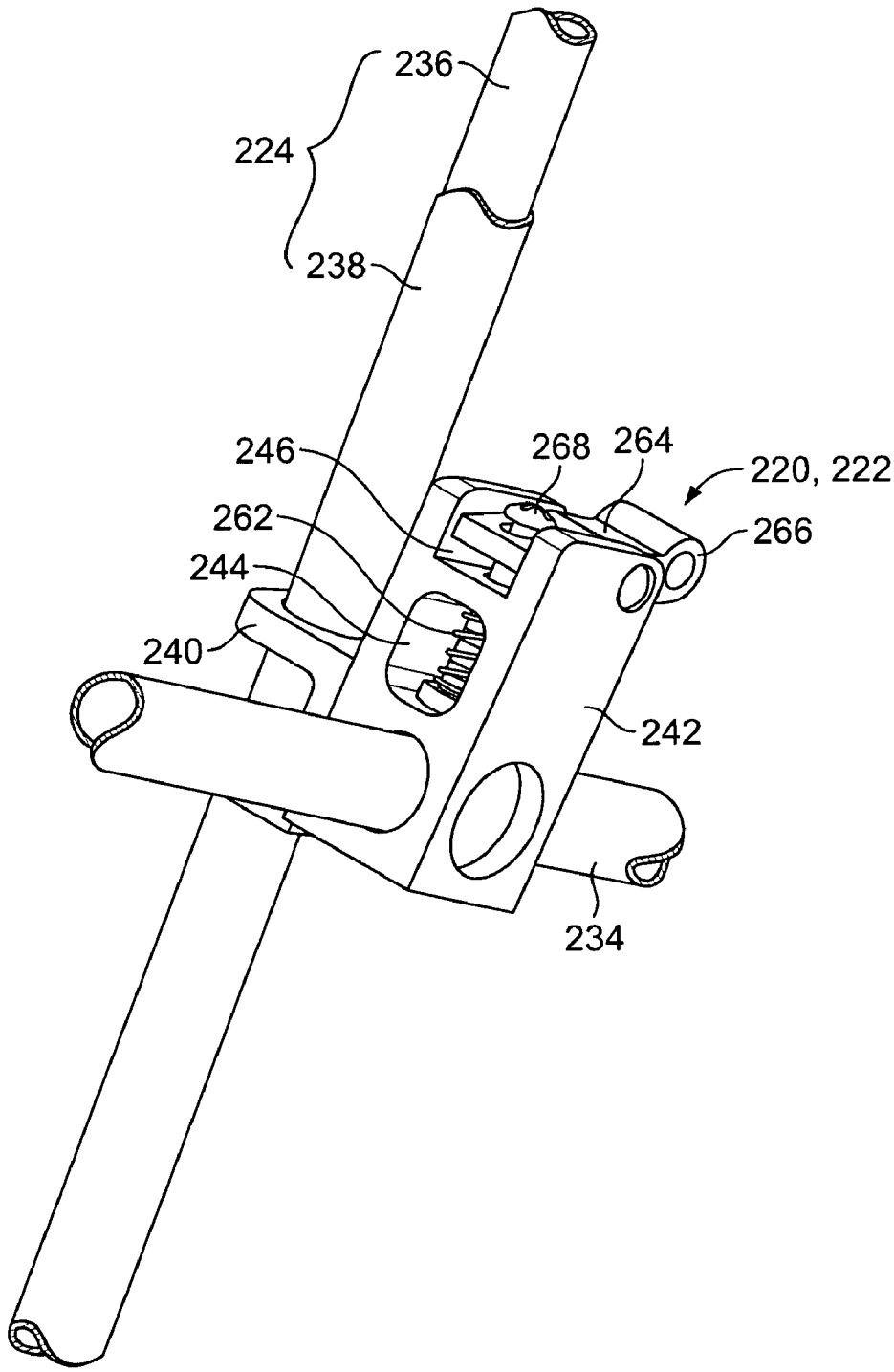
FIG. 19 is a detail view of the adjustable clip of the present invention.
Figure 20:
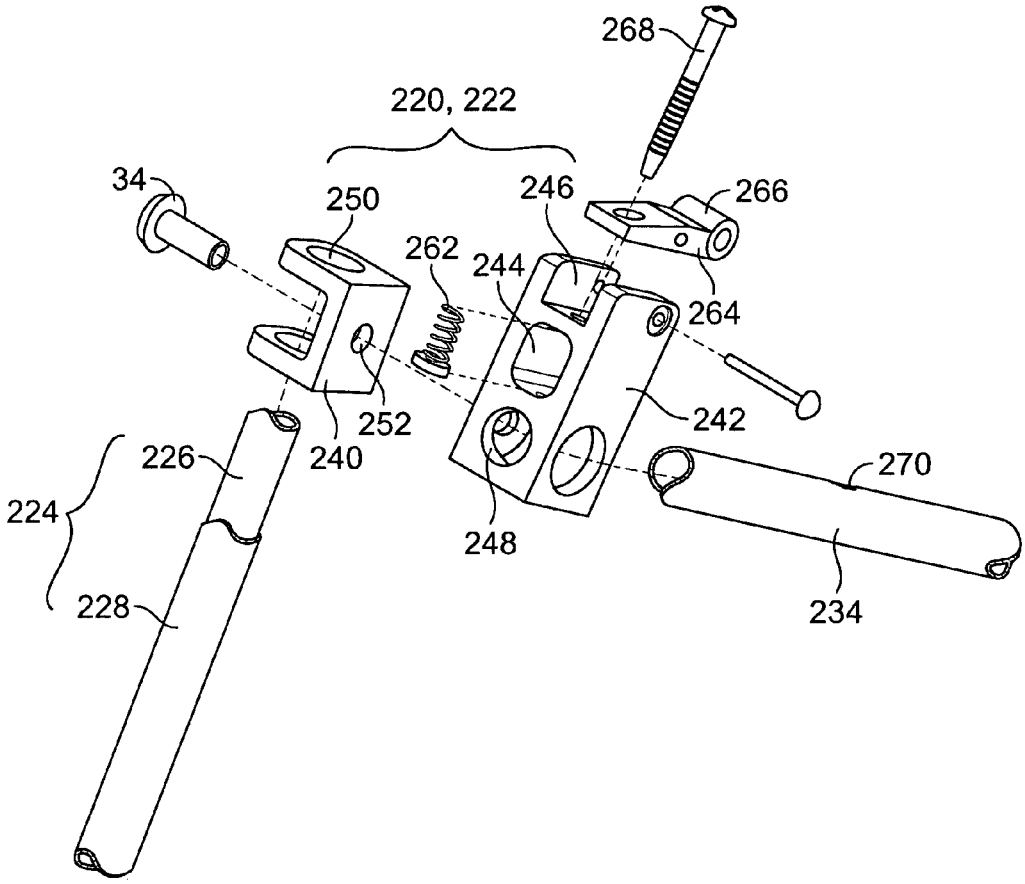
FIG. 20 is an exploded detail view of the adjustable clip of the present invention.
Figure 21:
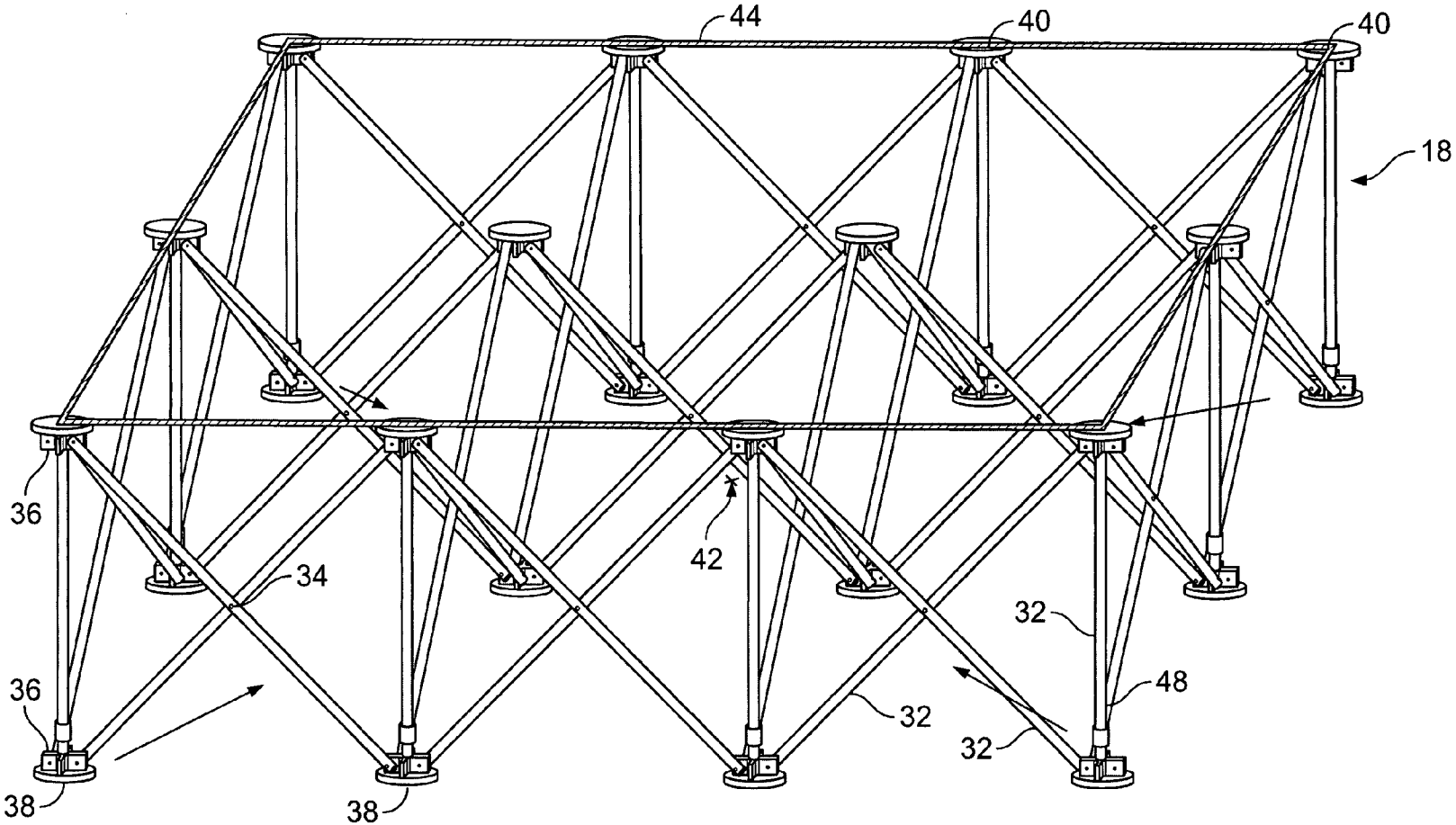
FIG. 21 is a perspective view of the collapsible frame in expanded position.
Figure 22:
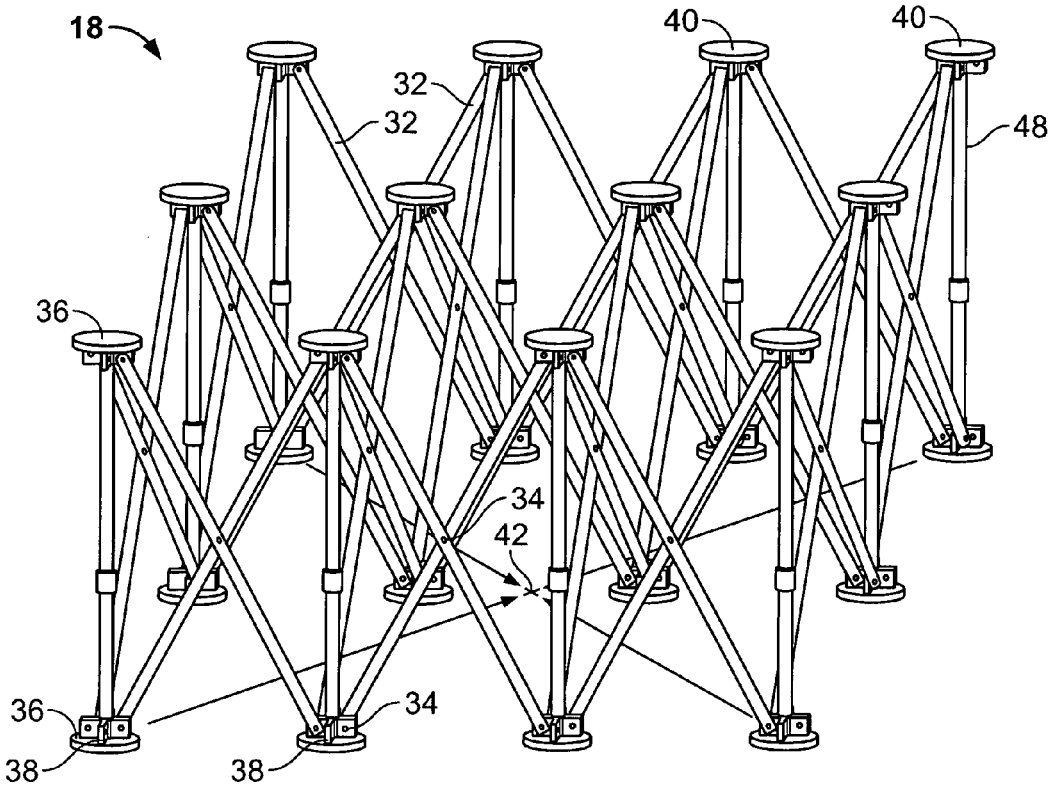
FIG. 22 is a perspective view of the collapsible frame in partially collapsed position.
Figure 23:
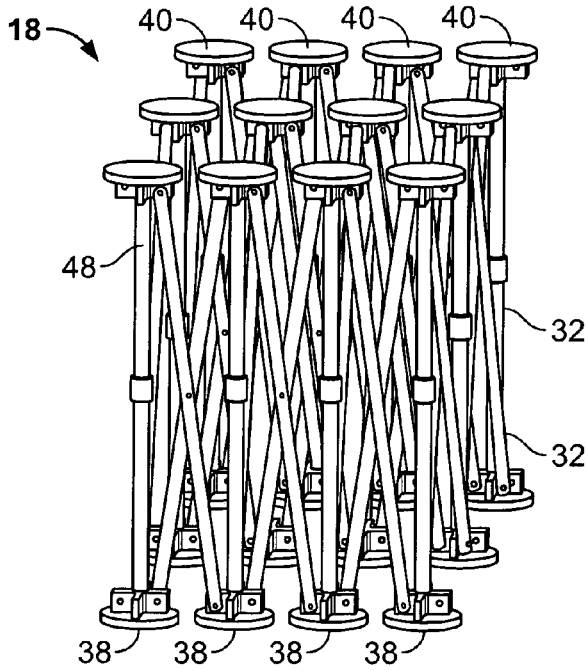
FIG. 23 is a perspective view of the collapsible frame in fully collapsed position.

FIG. 18 shows the detail circle F of FIG. 17 in closer detail, and FIGS. 19 and 20 show the adjustable clip 222 in perspective and exploded views respectively. Referring to FIGS. 18–20, the adjustable clip 222 includes pivotal bracket 240 and adjuster housing 242. The adjuster housing 242 includes a housing cavity 244, housing groove 246 and housing through-hole 248, through which downward angled member 234 passes and is allowed to slide unless stopped by a retention notch 270. A release lever 264 having an end 266, is pivotally attached to the adjuster housing 242. A pin 268 is biased by spring 262 to engage the retention notches 270 until forced away from engagement by pressing on the end 266 of the release lever 264.

Pivotal bracket 240 is attached to the adjuster housing 242 by a pivot 34 which passes through the bracket pivot hole 252. The pivotal bracket 240 includes a set of bracket through-holes 250 through which the telescoping pole 224 passes. The pivotal bracket 240 is allowed to slide freely along the telescoping pole 224, and the angle of the pivotal bracket 240 relative to the adjuster housing 242 is also allowed to rotate freely.

In FIG. 18, a first retention notch 272 and a second retention notch 274 are shown. When the frame is in reclining position 202, the pin 268 may engage the first retention hole 272 in order to give the bed stability in its reclining position. To incline the bed 200, the pin 268 is released by pressing the release lever 264. The adjuster clip 222 is then free to slide along the downward angled member 234 and telescoping member 224 as the inclining portion 206 of the bed 200 raises. The pivotal bracket 240 is allowed to pivot relative to the adjuster housing 242 as the adjuster clip 222 moves. The adjuster housing 242 moves along the downward angled member 234 until the tip of the pin 268 reaches the second retention notch 274, which the spring 262 again engages to maintain the frame in an inclined angle until released by the release lever 264.

The mattress 214 will preferably have a fabric covering 216, to which portions of the frame 218 are attached, including the ends of the inner poles 226 so that they are drawn to telescope outward when the bed frame 218 is inclined, and are pushed back inward when the bed frame 218 is to be reclined. This fabric covering 216 and its attachment to portions of various frame members also allow the frame 218 to be self-expanding in response to inflation of an air mattress 14, as described above in reference to the previous embodiments. Also as described above, an air-pump, which may be remote controlled, may be used to inflate the air mattress, and a pressure-sensing valve may be used to turn off the pump when the appropriate pressure is reached.

Although two retention notches are shown in the preferred embodiment, it will be obvious to one skilled in the art that there could be more than two retention notches to allow intermediate angles of inclination between an upright position and reclining position. It is also possible that the fully reclining position can be maintained by allowing the mattress to lie on the upper connector assemblies so that a retention notch is not required, thus there may only a single retention notch.

It will also be obvious to one skilled in the art that many variations in the angle retention mechanism or adjustable clip mechanism are possible. As only one possible variation, instead of retention notches and pins, the angle of inclination can be established by the turning of a screw or wing nut, which compresses halves of a split-housing on the frame members., It is also possible that the clamp mechanism might be applied to the outer poles 228 of the telescoping poles 224. The adjustable clips 222 are shown being applied to three parallel frame members. It is of course possible that the frame, and the bed supported by it, be of different widths than that shown by the figures, and may use greater or fewer parallel frame members, so that there may be two parallel rows, or four or more rows, used in single width beds or king-sized beds respectively. Of three or four parallel rows, clips or clamps may be applied to fewer than all parallel rows, such as only the outer rows, etc.

While various embodiments have been described above, it should be understood that they have been presented by way of example only, and not, limitation. Thus, the breadth and scope of a preferred embodiment should not be limited by any of the above described exemplary embodiments, but should be defined only in accordance with the following claims and their equivalents.

INDUSTRIAL APPLICABILITY

The embodiments of the present invention 10, 100, 200 present an easy and attractive way of providing bedding for overnight guests or visitors. The articulated support frame 18 which includes a number of frame members 32 which are attached to each other at pivots 34, which are positioned at the midpoints of the frame members 32 and at pivot assemblies 36 in the feet 38 and upper connector assemblies 40. These pivot assemblies 36 and pivots 34 connect all the frame members 32 to each other, so there are no loose pieces to be gathered and assembled. They also allow the frame 18 as a whole to be collapsed or expanded in a very easy and efficient manner. Force directed at any one of the corners causes movement in all the other corners, so that there is movement of the whole frame in either an inward or outward direction, relative to a central area 42. The pivots 34 allow the frame structure 18 to move towards a central area 42 from all sides as a unit when the frame 18 is to be collapsed, and to move away from this central area 42 when expanding.

In operation, the bed 10, 100, 200 will be assumed to start in a collapsed configuration 72. The mattress 14 is squeezed together and is generally surrounded by the support frame 18, the frame 18 previously having been drawn together towards the central area 42, discussed above. The air mattress 14 is preferably attached to the frame 18 at multiple points, either directly, or by being at least partially enclosed by a fabric covering 16 which is, in turn, attached at multiple points to the frame 18. The frame 18 is set upon its feet 38, and inflated, either by the user's lung power or by activation of an electric pump 60. If the preferred air pump 60 is used, it is activated, either by operation of a manual on-off switch, or by pressing the button 68 on a remote control 64. The air pump 60 begins filling the air mattress 14 which then begins to expand generally out from the central area 42. As the mattress 14 expands it presses laterally on the members of the frame 18, which pushes them also in the direction away from the central area 42. The feet 38 may be optionally fitted with low friction pads which can thus slide across floor surfaces, or may also be fitted with wheels to allow the frame 18 to expand easily and without hindrance.

A further embodiment 200 includes an inclining portion 206 by which the bed 200 may be elevated to allow the user to sit up in bed. Such an inclining bed 200 allows the user, who may be bed-ridden, or merely relaxing, to assume a sitting position for reading, watching television, etc. This provides many advantages for dwellers in small apartments or otherwise limited floor space so that the bed 200 may serve as a lounger or a sort of sofa when desired, while still allowing the bed to be folded to a compact bundle for storage. As with the other embodiments, the bed 200 may include an air mattress 14 which can be attached to the bed frame 218 at multiple points and thus expand it automatically as the air mattress 14 expands.

The present invention 10, 100, 200 will find much application in user's homes, in commercial travel lodges, such as hotels, etc. where an extra bed may be needed, and may also find use in business offices to replace the occasional folding cot presently used by workaholics.

For the above, and other, reasons, it is expected that the air bed with elevated and self-expanding support structure 10, 100 of the present invention will have widespread industrial applicability. Therefore, it is expected that the commercial utility of the present invention will be extensive and long lasting.

What is claimed is:

1. A bed frame comprising:

a plurality of frame members, each frame member of said plurality of frame members having a first end, a second end and an intermediate point therebetween;

a plurality of pivots, each pivot of said plurality of pivots pivotally connecting two frame members of said plurality of frame members at said intermediate point;

a plurality of first connector assemblies; and a plurality of second connector assemblies, each said frame member pivotally coupled at said first end to a corresponding first connector assembly of said plurality of first connector assemblies and pivotally coupled at said second end to a corresponding second connector assembly of said plurality of second connector assemblies, said bed frame movable between a collapsed position and an extended position in response to inflation of an inflatable mattress coupled to one of said plurality of first connector assemblies and said plurality of second connector assemblies, in the extended position said one of said plurality of first connector assemblies and said second connector assemblies configured substantially planar to support said mattress.

2. A bed frame in accordance with claim 1 further comprising:

a plurality of first pivot assemblies, each first pivot assembly of said plurality of first pivot assemblies pivotally attaching said first end to a corresponding first connector assembly of said plurality of first connector assemblies; and a plurality of second pivot assemblies, each second pivot assembly of said plurality of second pivot assemblies pivotally attaching said second end to a corresponding second connector assembly of said plurality of second connector assemblies.

3. A bed frame in accordance with claim 1 wherein a portion of said bed frame is movable between a reclined configuration and an inclined configuration with said bed frame in said extended position.

4. A bed frame in accordance with claim 1 further comprising at least one extendable corner upright coupling a corner first connector assembly and a corresponding corner second connector assembly.

5. A bed frame in accordance with claim 4 wherein said at least one corner upright is slidably extendable.

6. A bed frame for supporting a mattress, said bed frame comprising:

a plurality of frame members, each frame member of said plurality of frame members having a first end, a second end and an intermediate point therebetween;

a plurality of pivots, each pivot of said plurality of pivots pivotally connecting two frame members of said plurality of frame members at said intermediate point;

a plurality of first connector assemblies;

a plurality of second connector assemblies;

a plurality of first pivot assemblies, each first pivot assembly of said plurality of first pivot assemblies pivotally attaching said first end to a corresponding first connector assembly of said plurality of first connector assemblies; and a plurality of second pivot assemblies, each second pivot assembly of said plurality of second pivot assemblies pivotally attaching said second end to a corresponding second connector assembly of said plurality of second connector assemblies, said bed frame movable between a collapsed position and an extended position, one of said plurality of first connector assemblies and said plurality of second connector assemblies supporting said mattress in the extended position, in the extended position each of said plurality of first connector assemblies and said second connector assemblies configured substantially planar to support said mattress, said mattress configured to inflate and deflate, and to lie on one of said plurality of first connector assemblies and said plurality of second connector assemblies in the extended position.

7. A bed frame in accordance with claim 6 further comprising a support webbing connecting said plurality of first connector assemblies.

8. A bed frame in accordance with claim 6 wherein each said second connector assembly comprises a low friction device.

9. A bed frame in accordance with claim 6 further comprising at least one extendable corner upright coupling a corner first connector assembly and a corresponding corner second connector assembly, said at least one corner upright including a first member slidably positioned within a second member.

10. A bed frame comprising:

a plurality of frame members, each frame member of said plurality of frame members having a first end, a second end and an intermediate point therebetween;

a plurality of pivots, each pivot of said plurality of pivots pivotally connecting two frame members of said plurality of frame members at said intermediate point;

a plurality of first connector assemblies; and a plurality of second connector assemblies, each said frame member pivotally coupled at said first end to a corresponding first connector assembly of said plurality of first connector assemblies and pivotally coupled at said second end to a corresponding second connector assembly of said plurality of second connector assemblies, said bed frame movable between a collapsed position and an extended position, at least one first connector assembly and at least one second connector assembly positioned within a perimeter of said bed frame in the extended position, in the extended position each of said plurality of said first connector assemblies and said second connector assemblies configured substantially planar to support said mattress, said mattress configured to inflate and deflate, and to lie on one of said plurality of first connector assemblies and said plurality of second connector assemblies in the extended position.

11. A bed frame in accordance with claim 10 wherein one of said plurality of first connector assemblies and said plurality of second connector assemblies supports said mattress in the extended position.

12. A bed frame in accordance with claim 10 further comprising at least one extendable corner upright coupling a corner first connector assembly and a corresponding corner second connector assembly.

13. A support frame configured to support a mattress, said support frame comprising:

a plurality of frame members, each frame member of said plurality of frame members having an upper end and a lower end, said upper end pivotally attached to a corresponding upper connector assembly of a plurality of upper connector assemblies, and said lower end pivotally attached to a foot; and a plurality of extendable corner uprights, each corner upright of said plurality of corner uprights coupling a corner upper connector assembly and a corresponding foot, and including a first member slidably positioned within a second member, said support frame movable between a collapsed position and an extended position, in the extended position said plurality of upper connector assemblies configured substantially planar to support said mattress, said mattress configured to inflate and deflate, and to lie on said plurality of upper connector assemblies.

14. A support frame in accordance with claim 13 wherein a low friction device is coupled to said foot.

15. A support frame in accordance with claim 14 wherein said low friction device comprises one of a low friction pad and a wheel.

16. A support frame in accordance with claim 13 wherein each said corner upright is extended with said support frame in a collapsed position.

17. A support frame in accordance with claim 13 wherein said support frame configured to be deployed in response to inflation of said mattress.

18. A support frame configured to support a mattress comprising a plurality of frame members coupled in a scissor structure and configured to be deployed in response to inflation of said mattress from a collapsed position to an extended position, in the extended position each connector assembly of a plurality of connector assemblies coupled to a corresponding frame member and said plurality of connector assemblies configured substantially planar to support said mattress, and a plurality of extendable corner uprights, each corner upright of said plurality of corner uprights coupling a corner upper connector assembly and a corresponding foot, and including a first member slidably positioned within a second member.

19. A support frame in accordance with claim 18 wherein said plurality of frame members is configured to be deployed in two dimensions in response to inflation of said mattress.

20. A method for extending a collapsible bed frame, said method comprises:

providing a collapsible bed frame including a plurality of scissor frame members;

providing an inflatable mattress coupled to the scissor frame members; and extending each of a plurality of first connector assemblies and a plurality of second connector assemblies outwardly with respect to a central area of the bed frame in response to inflation of the mattress from a collapsed position to an extended position, in the extended position a plurality of connector assemblies each coupled to a corresponding frame member and configured substantially planar for supporting the mattress.

* * * * *